US005890635A

United States Patent [19]

Wu et al.

[11] Patent Number: 5,890,635

[45] Date of Patent: Apr. 6, 1999

[54] CARRYING ATTACHMENT FOR A CONTAINER

[75] Inventors: Nai-Foun Wu; Eric Wu, both of Taipei Hsien, Taiwan

[73] Assignee: Dyna Chain Industrial Co., Ltd., Chung-Ho, Taiwan

[21] Appl. No.: 13,642

[22] Filed: Jan. 26, 1998

[51] Int. Cl.[6] ..... A45F 3/14

[52] U.S. Cl. ..... 224/148.4; 224/148.7; 224/257; 24/459; 24/625; 215/395

[58] Field of Search ..... 224/148.4, 148.7, 224/257, 258; 24/625, 3.4, 459; 248/312, 312.1; 215/395, 396, 397, 399; 220/754; D3/229; 294/34, 27.1, 166, 31.2

[56] References Cited

U.S. PATENT DOCUMENTS

| | | | |
|---|---|---|---|
| 5,203,481 | 4/1993 | Dobbins et al. | 224/148.4 |
| 5,413,261 | 5/1995 | Wu | 224/148.4 |
| 5,765,888 | 6/1998 | Stack | 224/148.4 |

*Primary Examiner*—Linda J. Sholl

*Attorney, Agent, or Firm*—Brooks & Kushman P.C.

[57] ABSTRACT

A carrying attachment includes a clamping member and a retaining member. The clamping member includes a lug portion with a flat major surface, and left and right jaw arms which extend from the first lug portion and which are of a dimension sufficient for flexing toward each other. Each of the jaw arms includes a clamping segment that defines an inner clamping wall transverse to the flat major surface, and a first outer wall. The inner clamping walls of the clamping segments of the jaw arms are shaped so as to clamp a constricted part of a container therebetween. A hook end portion extends from the clamping segment and defines an inner wall and a second outer wall which are transverse to the flat major surface and which form deflection junctures with the inner clamping wall and the first outer wall. The hook end portion has a snapping protrusion that extends from the second outer wall in a direction opposite to the inner wall. The retaining member includes a second lug portion with a flat major surface, and a receiving portion which has an end wall transverse to the flat major surface, and a guiding groove with converging left and right guideways. Two retaining recesses are formed through the receiving portion distal from the end wall and transverse to the flat major surface.

3 Claims, 6 Drawing Sheets

CARRYING ATTACHMENT FOR A CONTAINER

BACKGROUND OF THE INVENTION

1. Field of the Invention

The invention relates to a carrying attachment, more particularly to a carrying attachment for clamping a constricted part of a container. The carrying attachment can be fittingly attached to a strap to facilitate carrying of the container.

2. Description of the Related Art

Referring to FIGS. 1*a* and 1*b*, a conventional carrying attachment 1 for clamping a constricted part of a container is shown to include two identical clamping members 11 of molded plastic material. Each of the clamping members 11 has a semi-circular intermediate portion 111 that defines an inner clamping wall 110A, and left and right lug portions 111, 112 that extend outwardly and laterally from two distal ends of the intermediate portion 111, and that have strap retaining holes 111A formed respectively therethrough such that two end portions of a carrying strap (shown by broken lines) can pass through the strap retaining holes 111A. One of the clamping members 11 further has a snapping protrusion 111B projecting therefrom transverse to the clamping wall 110A and insertable through an engagement hole 111C that is formed through the other one of the clamping members 11.

As illustrated, in use, the clamping members 11 are disposed side-by-side in such a manner that the clamping walls 110A of the intermediate portions 110 cooperatively clamp the constricted part of the bottle (shown by broken lines). The snapping protrusion 111B is then forced through the engagement hole 111C. Carrying of the container is facilitated with the use of the carrying strap.

Note that the snapping protrusion 111B is constructed in order to facilitate engagement with the engagement hole 111C. When it is desired to remove the bottle from the conventional carrying attachment, a tool, such as a flat-tip screw driver, must be employed to force the snapping protrusion 111B out of the engagement hole 111C.

SUMMARY OF THE INVENTION

Therefore, the object of this invention is to provide a carrying attachment which is adapted to be mounted easily on or dismounted from the constricted part of a container.

The carrying attachment of this invention is used for clamping a constricted part of a container and is adapted to be attached to a strap to facilitate carrying of the container. The carrying attachment includes a clamping member of molded plastic material, and a retaining member. The clamping member includes a first lug portion with a first flat upper major surface, and left and right jaw arms. The first lug portion defines a first attachment end adapted to be attached to one end of the strap. The left and right jaw arms extend from the first lug portion and are of a dimension sufficient to enable the same to flex toward each other in a direction parallel to the first flat upper major surface. Each of the jaw arms includes a clamping segment and a hook end portion. The clamping segment has a distal end relative to the first lug portion, and defines an inner clamping wall transverse to the first flat upper major surface, and a first outer wall opposite to the inner clamping wall. The inner clamping walls of the clamping segments of the jaw arms are shaped so as to be adapted to clamp the constricted part of the container therebetween when the jaw arms are moved toward each other. The hook end portion extends from the distal end of the clamping segment, and defines an inner wall and a second outer wall which are transverse to the first flat upper major surface and which form deflection junctures with the inner clamping wall and the first outer wall, respectively. The hook end portion has a snapping protrusion that extends from the second outer wall in a direction opposite to the inner wall. The retaining member includes a second lug portion with a second flat upper major surface, and a receiving portion. The second lug portion defines a second attachment end adapted to be attached to the other end of the strap. The receiving portion extends from the second lug portion and includes an engagement end wall which is distal to the second lug portion and which is transverse to the second flat upper major surface, and a receptacle which is disposed inwardly of the engagement end wall and which extends parallel to the second flat upper major surface for receiving the jaw arms. The receptacle defines a guiding groove and left and right guideways. The guiding groove is opened at the engagement end wall and that extends toward the second attachment end in a parallel direction to the second flat upper major surface for insertion of the jaw arms. The left and right guideways are disposed transverse to the second flat upper major surface and laterally define the guiding groove. The left and right guideways converge from the engagement end wall toward the second attachment end. A pair of retaining recesses are disposed in the proximate ends of the left and right guideways relative to the second attachment end, and extend in a transverse and divergent direction relative to the left and right guideways respectively. A width that is defined by the proximate ends of the left and right guideways is slightly shorter than a width defined by the second outer walls of the hook end portions of the jaw arms proximate to the snapping protrusions when the jaw arms are removed from the guiding groove. When the jaw arms are forced into the guiding groove, the converging surfaces on the left and right guideways will impart a gradually increasing outwardly and transversely biasing force relative to the left and right guideways on the snapping protrusions that slide thereon, thereby thrusting the snapping protrusions into the retaining recesses once the snapping protrusions have slid over the proximate ends of the left and right guideways.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

Figure 1A:
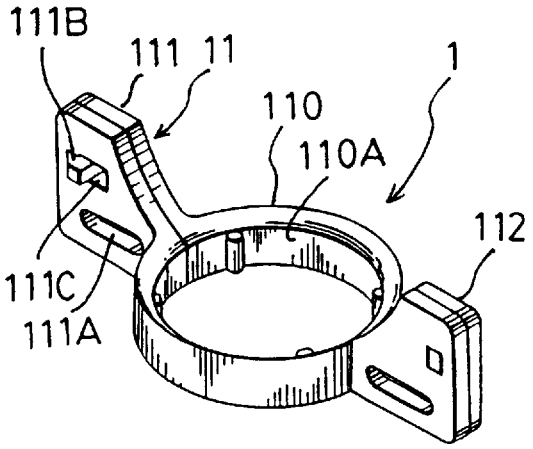
FIG. 1a PRIOR ART
FIGS. 1*a* and 1*b* illustrate a perspective and schematic view of a conventional carrying attachment in use.
Figure 1B:
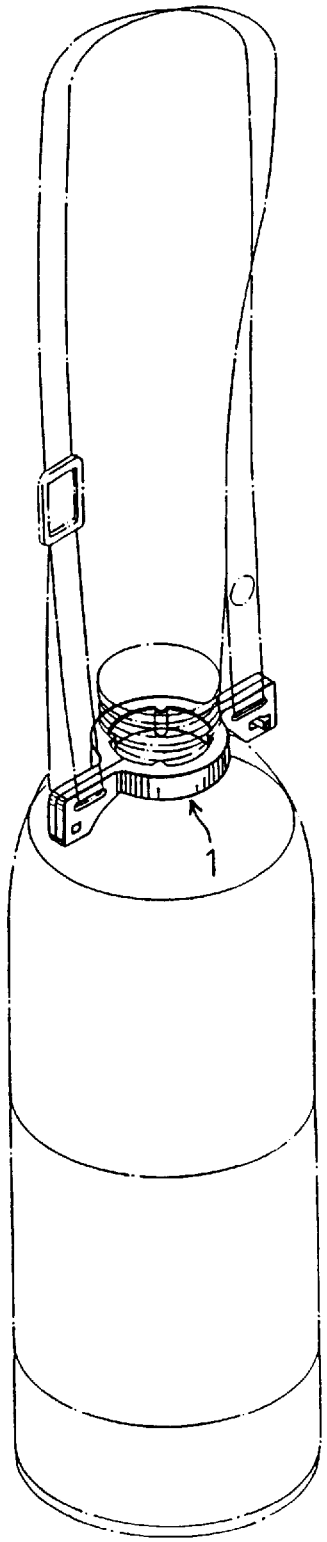
FIG. 1b PRIOR ART
Figure 2:
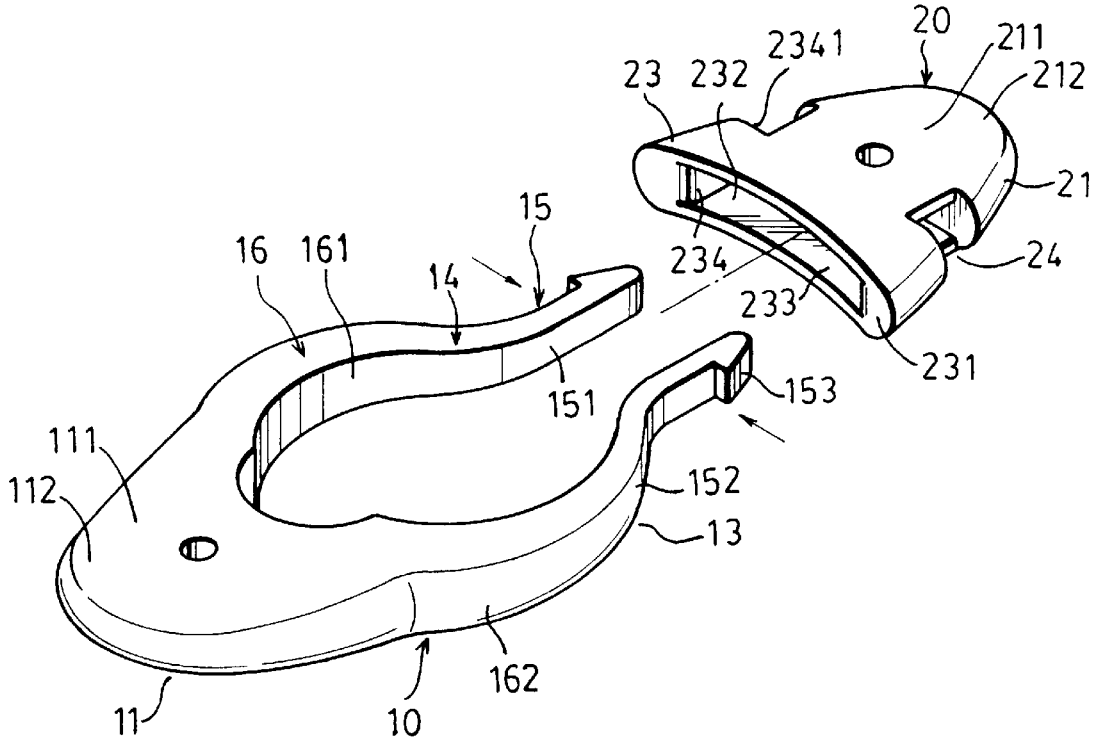
FIG. 2 is a perspective view of a preferred embodiment of a carrying attachment of this invention.

Referring to FIG. 2, the preferred embodiment of a carrying attachment of this invention is used to clamp a constricted part of a container and is adapted to be attached to a strap to facilitate carrying of the container. The carrying attachment includes a clamping member 10 of molded plastic material, and a molded retaining member 20.

Figure 4:
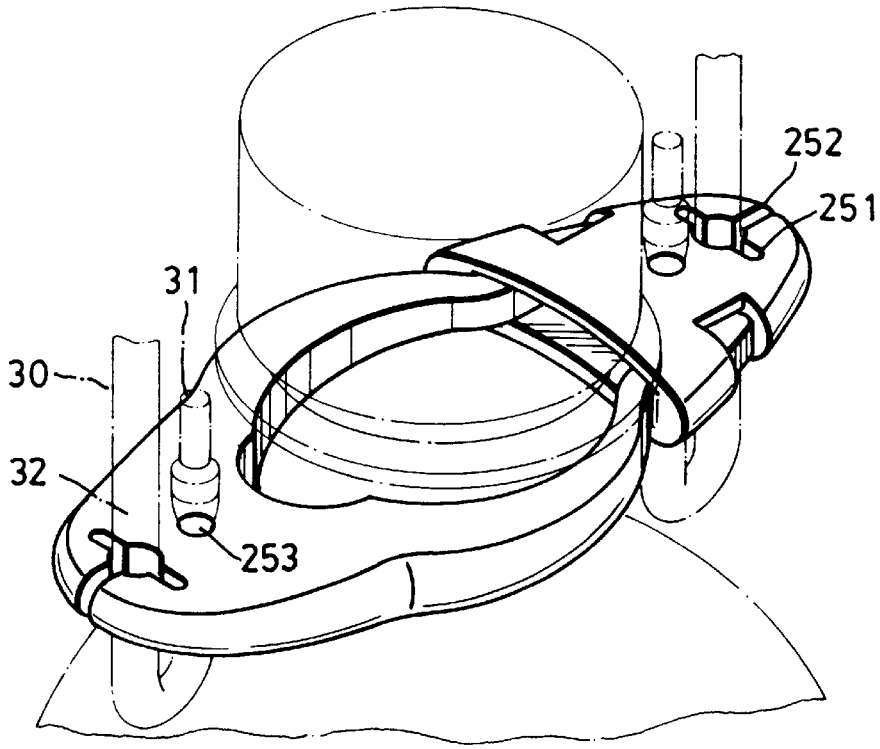
FIG. 4 illustrates the modified preferred embodiment in use.

As illustrated, the clamping member 10 includes a first lug portion 11 with a first flat upper major surface 111 and left and right arms 13. The first lug portion 11 defines a first attachment end 112 adapted to be attached to one end of the strap. The left and right jaw arms 13 extend from the first lug portion 11 are of a dimension sufficient to enable the same to flex toward each other in a direction parallel to the first flat upper major surface 111. Each of the jaw arms 13 includes a clamping segment 16 and a hook end portion 15. The clamping segment 16 has a distal end relative to the first lug portion 11, and defines an inner clamping wall 161 transverse to the first flat upper major surface 111, and a first outer wall 162 opposite to the inner clamping wall 161. The inner clamping walls 161 of the clamping segments 16 are shaped so that the constricted part of a container can be clamped therebetween when the jaw arms 13 are moved toward each other, as shown in FIG. 4. The hook end portion 15 extends from the distal end of the clamping segment 16, and defines an inner wall 151 and a second outer wall 152 which are transverse to the first flat upper major surface 111 and which form deflection junctures 14 with the inner clamping wall 161 and the first outer wall 162, respectively. The hook end portion 15 further has a snapping protrusion 153 which extends from the second outer wall 152 in a direction opposite to the inner wall 151.

The retaining member 20 includes a second lug portion 21 with a second flat upper major surface 211, and a receiving portion 23. The second lug portion 21 defines a second attachment end 212 that is adapted to be attached to the other end of the strap. The receiving portion 23 extends from the second lug portion 21, and includes an engagement end wall 231 distal to the second lug portion 21 and transverse to the second flat upper major surface 211, and a receptacle 232 which is disposed inwardly of the engagement end wall 231 and which extends parallel to the second flat upper major surface 211 for receiving the jaw arms 23. The receptacle 232 defines a guiding groove 233 which opens at the engagement end wall 231 and which extends toward the second attachment end 212 in a parallel direction to the second flat upper major surface 211 for insertion of the jaw arms 13, and left and right guideways 234 which are disposed transverse to the second flat upper major surface 211 and which laterally define the guiding groove 233. In the preferred embodiment, the left and right guideways 234 converge from the engagement end wall 231 toward the second attachment end 212 of the second lug portion 21.

The retaining member 20 further has a pair of retaining recesses 24 respectively disposed in the proximate ends 2341 of the left and right guideways 234 relative to the second attachment end 212. The retaining recesses 24 extend in a transverse and divergent direction relative to the left and right guideways 234 respectively such that a width that is defined by the proximate ends 2341 of the left and right guideways 234 is slightly shorter than the width that is defined by the second outer walls 152 proximate to the snapping protrusions 153 when the jaw arms 13 are removed from the guiding groove 233. As such, when the jaw arms 13 are forced into the guiding groove 233, the converging surfaces on the left and right guideways 234 will impart a gradually increasing outwardly and transversely biasing force relative to the left and right guideways 234 on the snapping protrusions 153 that slide thereon. Thus, the snapping protrusions 153 are consequently thrusted into the retaining recesses 24 once the snapping protrusions 153 have slid over the proximate ends 2341 of the left and right guideways 234.

Figure 3:
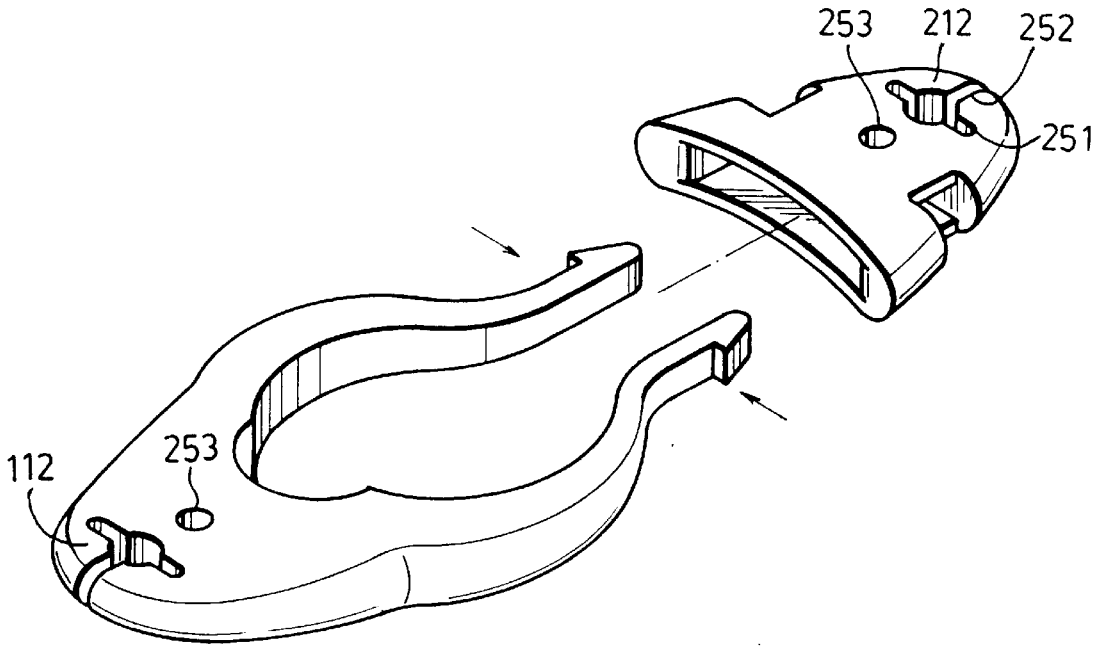
FIG. 3 illustrates a modified preferred embodiment of this invention.

FIG. 3 illustrates a modified preferred embodiment of this invention which has a structure similar to that of the previous embodiment, except that the first and second lug portions 112, 212 have a strap retaining hole 251 formed therethrough for passage of the strap. The first and second lug portions 112, 212 further respectively have a respective split 252 which is formed therethrough and which extends to communicate with the strap retaining hole 251 so as to facilitate insertion of the strap into the strap retaining hole 251. Each of the first and second lug portions 112, 212 can be further provided with an additional strap retaining hole 253 inboard to the strap retaining hole 251 such that one end portion 31 of the strap 30 can be retained in the additional strap retaining hole 253 while a segment 32 thereof is passed through the hole 251, as best shown in FIG. 4.

Figure 5:
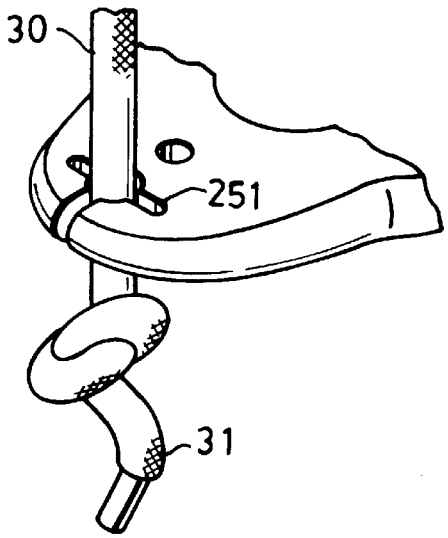
FIGS. 5 and 6 show how one end portion of a strap is fastened to the modified preferred embodiment.
Figure 6:
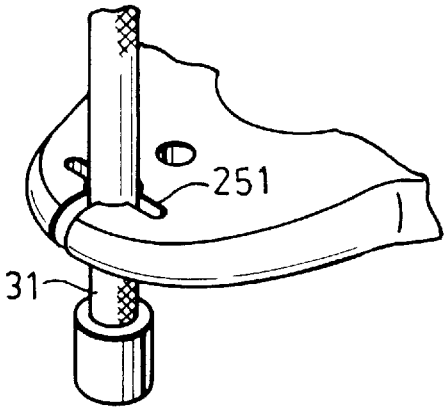

FIGS. 5 and 6 illustrate other ways of retaining one end portion 31 of the strap 30 in the strap retaining holes 251.

Figure 7:
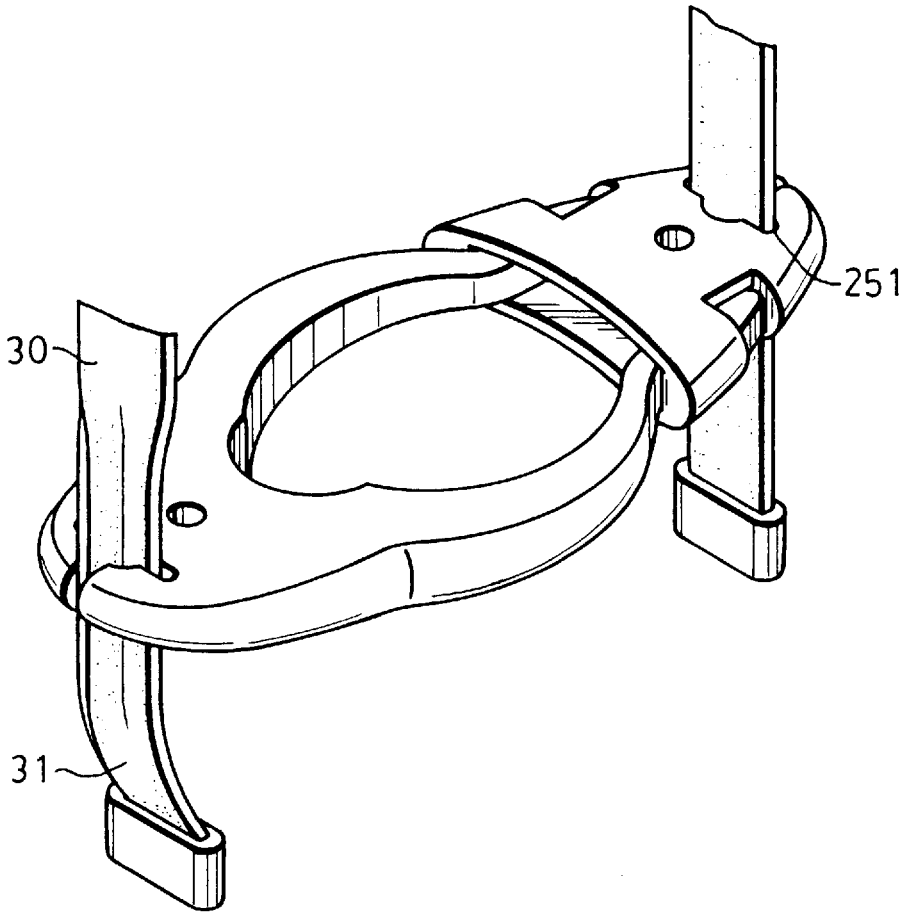
FIGS. 7 and 8 show how one end portion of another strap is fastened to the modified preferred embodiment.
Figure 8:
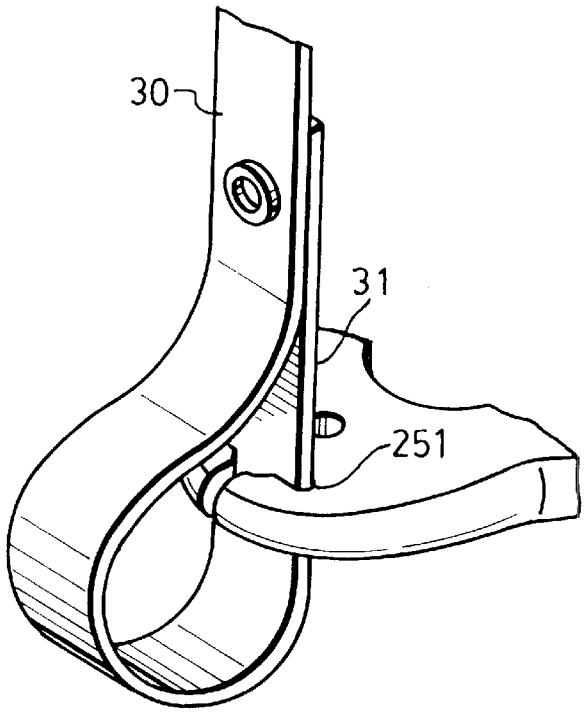

FIGS. 7 and 8 illustrate ways of retaining one end portion 31 of a flat strap 30 in the strap retaining holes 251.

Figure 9:
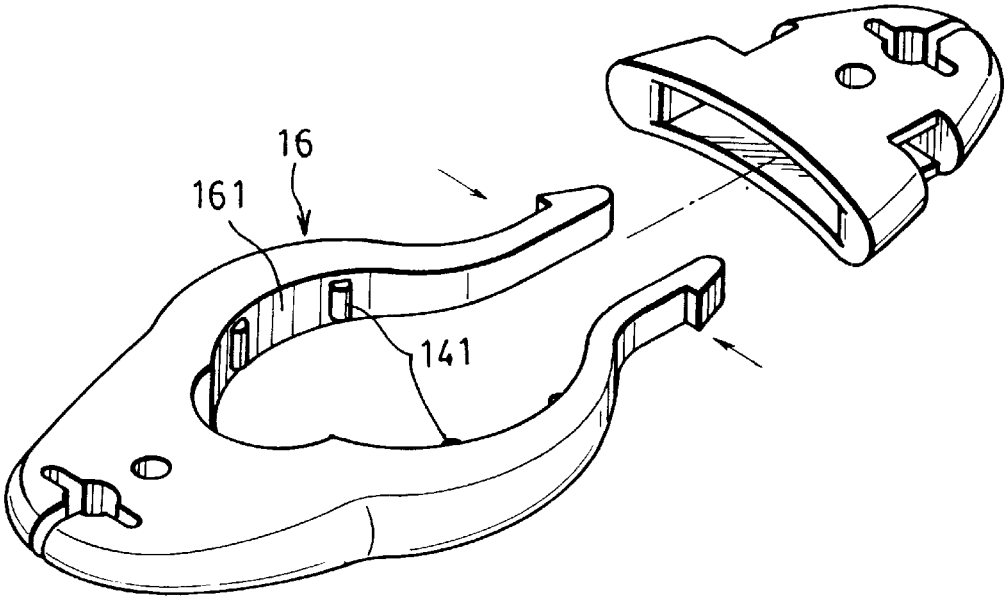
FIG. 9 shows still another preferred embodiment of this invention.
Figure 10:
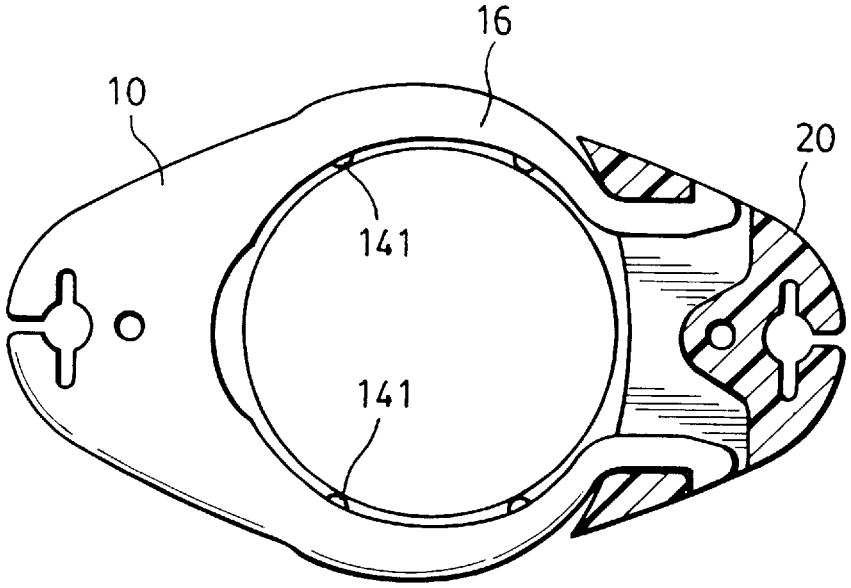
FIGS. 10 and 11 respectively show how the preferred embodiment can be used to clamp different constricted parts of two containers.
Figure 11:
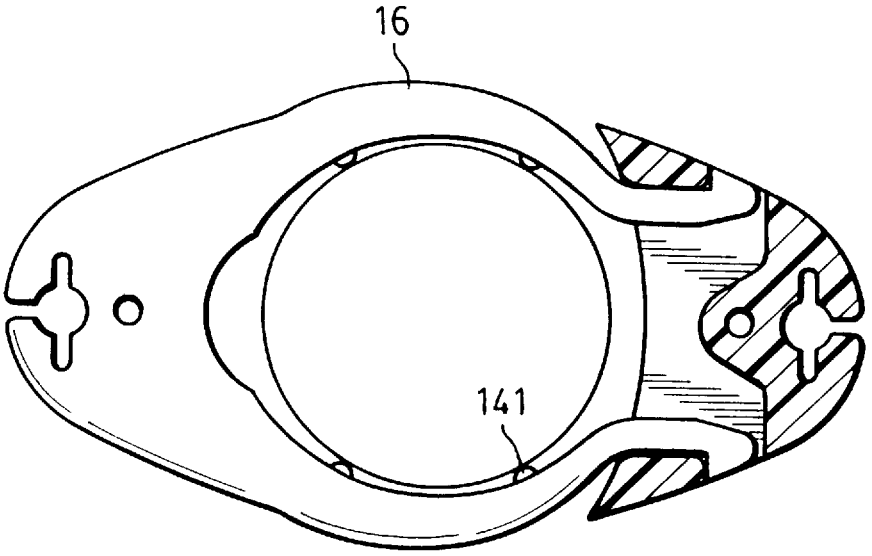

Referring to FIGS. 9, 10 and 11, another modified preferred embodiment is shown, wherein the inner clamping walls 161 of the left and right clamping segments 16 are formed with a plurality of gripping ribs 141 which extend transverse to the flat upper major surface 111 (see FIG. 2) to further strengthen the clamping force of the carrying attachment of this invention.

Since the jaw arms 13 of the carrying attachment of this invention provide enhanced flexibility when compared to the conventional carrying attachment, the constricted parts of different containers can be clamped between the clamping segments 16, as shown in FIGS. 10 and 11. In addition, the outwardly biasing force of the snapping protrusions 153 (see FIG. 2) facilitate removal of the clamp member 10 from the guiding groove 233 of the retaining member 20.

While the present invention has been described in connection with what is considered the most practical and preferred embodiments, it is to be understood that this invention is not limited to the disclosed embodiments but is intended to cover various arrangements included within the spirit and scope of the broadest interpretation so as to encompass all such modifications and equivalent arrangements.

I claim:

1. A carrying attachment for clamping a constricted part of a container and adapted to be attached to a strap to facilitate carrying of the container, comprising:

a clamping member of molded plastic material, said clamping member including a first lug portion with a first flat upper major surface, said first lug portion defining a first attachment end adapted to be attached to one end of the strap, and left and right jaw arms extending from said first lug portion and being of a dimension sufficient to enable said jaw arms to flex toward each other in a direction parallel to said first flat upper major surface, each of said jaw arms including a clamping segment having a distal end relative to said first lug portion, and defining an inner clamping wall transverse to said first flat upper major surface, and a first outer wall opposite to said inner clamping wall, said inner clamping walls of said clamping segments of said jaw arms being shaped so as to be adapted to clamp the constricted part of the container therebetween when said jaw arms are moved toward each other, and a hook end portion extending from said distal end of said clamping segment, said hook end portion defining an inner wall and a second outer wall which are transverse to said first flat upper major surface and which form deflection junctures with said inner clamping wall and said first outer wall respectively, said hook end portion having a snapping protrusion extending from said second outer walls in a direction opposite to said inner wall; and a retaining member including a second lug portion with a second flat upper major surface, said second lug portion defining a second attachment end adapted to be attached to the other end of the strap, a receiving portion extending from said second lug portion and including an engagement end wall distal to said second lug portion and transverse to said second flat upper major surface, and a receptacle disposed inwardly of said engagement end wall and extending parallel to said second flat upper major surface for receiving said jaw arms, said receptacle defining a guiding groove opened at said engagement end wall and extending toward said second attachment end in a parallel direction to said second flat upper major surface for insertion of said jaw arms, and left and right guideways disposed transverse to said second flat upper major surface and laterally defining said guiding groove, said left and right guideways converging from said engagement end wall toward said second attachment end, and a pair of retaining recesses respectively disposed in proximate ends of said left and right guideways relative to said second attachment end, and extending in a transverse and divergent direction relative to said left and right guideways respectively, wherein a width defined by said proximate ends of said left and right guideways is slightly shorter than a width defined by said second outer walls of said hook end portions of said jaw arms proximate to said snapping protrusions when said jaw arms are removed from said guiding groove, whereby, when said jaw arms are forced into said guiding groove, converging surfaces on said left and right guideways will impart a gradually increasing outwardly and transversely biasing force relative to said left and right guideways on said snapping protrusions that slide thereon, thereby thrusting said snapping protrusions into said retaining recesses once said snapping protrusions have slid over said proximate ends of said left and right guideways.

2. The carrying attachment as defined in claim 1, wherein each of said first and second lug portions has a strap retaining hole formed therethrough for passage of the strap.

3. The carrying attachment as defined in claim 2, wherein each of said first and second lug portions further has a split formed therethrough and extending to communicate with said strap retaining hole so as to facilitate insertion of the strap into said strap retaining hole.

* * * * *